US005464364A

United States Patent [19]

Roitner

[11] Patent Number: 5,464,364

[45] Date of Patent: Nov. 7, 1995

[54] APPARATUS FOR MACHINING A CONCIAL RING

[75] Inventor: Franz Roitner, Laakirchen, Austria

[73] Assignee: Miba Sintermetall Aktiengesellschaft, Laakirchen, Austria

[21] Appl. No.: 155,959

[22] Filed: Nov. 19, 1993

[30] Foreign Application Priority Data

Dec. 24, 1992 [AT] Austria ..... A2576/92

[51] Int. Cl.[6] ..... B24B 9/00

[52] U.S. Cl. ..... 451/194; 451/51

[58] Field of Search ..... 451/194, 180, 451/51, 61, 57, 58

[56] References Cited

U.S. PATENT DOCUMENTS

| | | | |
|---|---|---|---|
| 1,534,393 | 4/1925 | Joseph | 451/51 |
| 2,047,055 | 7/1936 | Blood | 451/51 |
| 4,497,138 | 2/1985 | Schreiber | 451/51 |
| 4,631,868 | 12/1986 | Hirohata | 451/51 |

*Primary Examiner*—Bruce M. Kisliuk

*Assistant Examiner*—Derris H. Banks

[57] ABSTRACT

An apparatus is described for machining a conical ring, particularly a friction ring, which has inside and outside conical machinable surfaces having parallel radially aligned generatrices, which apparatus comprises two coaxial machining tools which consist of an outer tool having an inside conical machining surface for machining the outside machinable surface of said ring and an inner tool having an outside conical machining surface for machining said inside machinable surface of said ring, which machining tools are mounted to be rotatable about a common axis relative to said ring and said ring is adapted to be held between said tools so as to be centered on said axis. The tools are mounted to be axially movable relative to each other to a range of positions in which said outside concial machinable surface of said ring is adapted to be in sliding contact with said inside conical machining surface of said outer tool and said outside conical machinable surface is adapted to be in sliding contact with said inside conical machining surface of said outer tool and said outside conical machinable surface is adapted to be in sliding contact with said inside conical machining surface of said outer tool at the same time and said tools are axially movable toward each other to a predetermined position, which is defined by stop means.

9 Claims, 1 Drawing Sheet

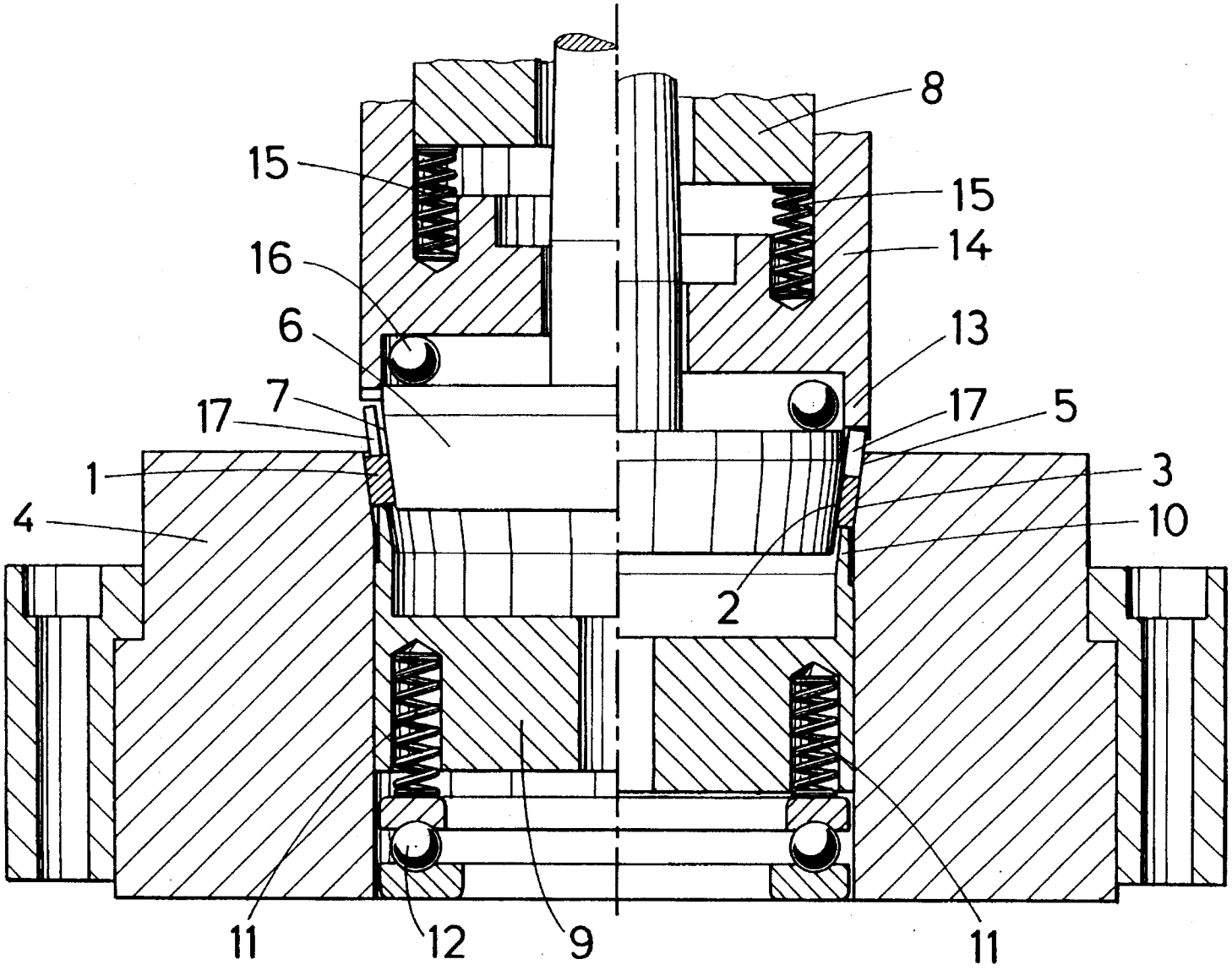
8
15
14
13
17
5
3
10
11
2
9
12
11
1
4
17
7
6
16
15

APPARATUS FOR MACHINING A CONCIAL RING

BACKGROUND OF THE INVENTION

1. Field of the Invention

This invention relates to an apparatus for machining a conical ring, particularly a friction ring, which has inside and ouside conical machinable surfaces having parallel radially aligned generatrices, which apparatus comprises two coaxial machining tools which consist of an outer tool having an inside conical machining surface for machining the outside machinable surface of said ring and an inner tool having an outside conical machining surface for machining said inside machinable surface of said ring, which machining tools are mounted to be rotatable about a common axis relative to said ring and said ring is adapted to be held between said tools so as to be centered on said axis.

2. Description of the Prior Art

To machine the conical friction surfaces of friction ring having a friction lining at least on one of its outside and inside surfaces for use in clutches or brakes, for example, it is known to provide tools which have an outside conical surface that is provided with a diamond-containing coating for polishing the inside friction surface of the conical friction ring. Because the friction ring must be held in position relative to the rotating tool which extends into the opening of the ring, the accuracy of the machining will depend on the centering of the tool relative to the conical ring and on the elastic deformation which is imparted to the ring by the tool. That elastic deformation of the ring adversely affects the accuracy which can be ensured. Similar remarks are applicable to the machining of the outside friction surfaces of a conical friction ring with a tool which comprises an inside conical machining surface for machining the outside friction surface of the ring. Because in a conical friction ring having inside and outside friction linings the tolerances specified for the machining of each friction surface accumulate to a total tolerance, such surfaces cannot be machined to a very high accuracy. Besides, the tool must be fixed in different positions and this involves additional work.

SUMMARY OF THE INVENTION

For this reason it is an object of the invention to provide for the machining of a conical ring, particularly a friction ring, which has inside and outside conical machinable surfaces having parallel radially aligned generatrices, an apparatus which is designed to permit an accurate machining of the inside and outside conical machinable surfaces with small deviations and with a relatively low expenditure of work.

In an apparatus of the kind described first hereinbefore that object is accomplished in accordance with the invention in that the two tools are adapted to be driven to rotate relative to each other and are coaxially arranged so that said inside and outside conical machining surfaces define between the a conical gap, which is adapted to accommodate the conical ring in a position in which it is adapted to float relative to said tools, and said tools are mounted to be axially movable relative to each other to a predetermined relative position.

A fast machining of the conical ring is ensured because the outside and inside conical friction surfaces of the conical friction ring are machined at the same time between the opposite inside conical machining surface and the outside conical machining surface formed on respective rotating tools, between which the ring is floating. As a result, separate means for fixing the workpiece are not needed, the structural expenditure is reduced and the ring can be more accurately machined because the conical ring can freely move into contact with the machining surfaces of the tools. This will prevent an occurrence of defects which could be caused by a misalignment of workpieces relative to the tool. Because the two conical machinable surfaces are machined at the same time by the two tools, between which the ring is floating, the ring will be machined under conditions which are similar to its conditions of use so that particularly small tolerances can be specified with a view to the intended use of the ring. Besides, the fact that the tools are axially moved toward each other to a predetermined position permits the inside and outside diameters of the workpiece to be specified with a small tolerance. The tools may consist of grinding tools or diamond-carrying polishing tools, which may be selected in dependence on the material of which the machinable surfaces are made.

The predetermined position to which said two tools are axially movable relative to each other may be defined by stop means, which may be axially adjustable in adaptation to different conical rings to be machined.

For a simultaneous machining of the inside and outside machinable surfaces of a conical ring, the two tools must be rotated relative to each other. Particularly desirable conditions will be obtained if the two tools are driven to rotate in mutually opposite senses.

There is a risk that a conical ring to be machined may not uniformly contact the tools throughout the periphery of the ring. That risk can be avoided in accordance with the invention in that the conical ring is axially engaged at opposite ends by two stops, which are axially guided to ensure that the workpiece can float relative to the ring during an axial movement of the two tools toward each other. Because the stops are axially displaceable it is ensured that the outside and inside surfaces of the conical ring will not be machined until a simultaneous machining of the ring on both sides is ensured because the ring is engaged by said tools on both sides.

A simple design will be obtained if the stops for axially engaging the conical ring are axially supported by springs on the holders for the two tools. In that case an axial adjustment of the two tools relative to each other after a ring to be machined has been inserted between the two tools will have the result that the ring is initally axially retained between the stops before the tools contact the machinable surfaces of the ring. Because the stops are resiliently supported in an axial direction the ring is axially displaceable relative to the two tools as is required.

The machining forces exerted on the ring should be uniformly distributed to the two tools. This requires the ring to be freely rotatable between the two tools. If the workpiece is held against a canting between axially spaced apart stops, that requirement can be met in a simple manner in that the axially spaced apart stops are mounted for a rotation about the tool axis relative to the toolholding means.

BRIEF DESCRIPTION OF THE DRAWING

The drawing is a simplified axial sectional view showing an illustrative embodiment of an apparatus in accordance with the invention for machining a conical friction ring having inside and outside conical friction surfaces.

DETAILED DESCRIPTION OF THE PREFERRED EMBODIMENT

The illustrated apparatus for machining a conical friction ring 1 having an inside conical friction surface 2 and an outside conical friction surface 3 comprises two tools, namely, an outer tool 4 having an inside conical machining surface 5 for machining the outside friction surface 3 and an inner tool 6 having an outside conical machining surface 7 for machining the inside friction surface 2 of the conical friction ring 1. Said tools 4 and 5 are coaxially rotatably mounted and are adapted to be driven to rotate in mutually opposite senses by drive means which are not shown for the sake of clearness.

To permit an axial displacement of the two tools 4 and 5 relative to each other, the tool 4 having the inside conical machining surface 5 is axially fixedly held in the illustrated embodiment and the other tool 6 is rotatably mounted in an axially displaceable toolholder 8. As a result, a friction ring 1 can be inserted into the cavity defined by the inside conical machining surface 5 of the tool 4 and the tool 6 can be engaged by the outside conical machining surface 7 of the friction ring 1 and can then be machined by both tools at the same time. For that purpose the tools may preferably consist of diamond-carrying polishing tools or of grinding tools.

A holder 9 comprising an annular stop 10 for axially engaging the friction ring 1 is disposed within the annular tool 4 provided with the inside conical machining surface 5. The holder 9 is mounted to be axially guided relative to the tool 4 and is axially supported by means of compression springs 11 on an axial rolling element bearing 12. That resilient support permits an axial displacement of the annular stop 10 relative to the toolholder for the tool 4. Similarly, an annular stop 13 for the friction ring 1 is associated with the tool 6 which has the outside conical machining surface 7. The stop 13 is constituted by a holder 14, which is supported by springs 15 on the toolholder 8, and the holder 14 is slidably guided relative to the toolholder 8. The holder 14 is rotatably supported relative to the tool 6 by means of an axial rolling element bearing 16.

When a friction ring 1 to be machined is inserted into the cavity defined by the inside conical machining surface 5 of the tool 4, that friction ring 1 will initially axially engage the stop 10. Thereafter the tool 6 provided with the outside conical machining surface 7 is axially moved by the associated toolholder 8 into engagement with the friction ring 1, which is now contacted at its machinable surfaces 2 and 3 by the respective tools 4 and 6. At this time the friction ring 1 is axially engaged at opposite ends by the stops 10 and 13 to prevent a canting of the ring. Because said stops are resiliently supported, the ring will still be axially displaceable while it is held against canting. For this reason the friction ring 1 can be machined on its machinable surfaces 2 and 3 by the inside conical machining surface 5 of the outer tool 4 and the outside conical machining surface 7 of the inner tool 6 at the same time. On the left side of the drawing the apparatus is shown in the position assumed shortly before the friction ring 1 is axially engaged at opposite ends by both stops 10 and 13. On the right side of the drawing the position is shown which is assumed when the workpiece has been machined and in which the outside conical machining surface 7 of the tool 6 has been moved into the cavity that is defined by the inside conical machining surface 5 of the tool 4 to a depth which is defined by stops 10 and 13. The friction ring 1 is axially held between the stops 10 and 13 so that it cannot be canted but is still axially displaceable relative to the tools.

In the illustrated embodiment the friction ring 1 is provided with axially protruding coupling elements 17, which are distributed around its periphery and which are engageable by the stop 13 which is associated with the tool 6.

It will be understood that the invention is not restricted by the illustrated embodiment. For instance, the apparatus may be used to machine not only friction rings but any conical ring which has inside and outside conical machinable surfaces having parallel radially aligned generatrices. Besides, the design features of the illustrative illustrated apparatus may be replaced by different design features because it is merely essential that the conical ring 1 which is to be machined can float between an inner conical machining surface and an outer conical machining surface of respective tools, which rotate relative to each other, and the tools are axially moved relative to each other so that the two machinable surfaces are machined at the same time.

I claim:

1. An apparatus for machining a conical ring having inside and outside conical machinable surfaces defining parallel generatrices, which comprises (a) an outer tool, and (b) an inner tool, (1) the tools being mounted coaxially to be rotatable about a common axis, (2) the outer tool having an inside conical machining surface for machining the outside conical machinable surface of the ring and the inner tool having an outside conical machining surface for machining the inside conical machinable surface of the ring when the ring is disposed between the machining surfaces of the tools and is centered on the common axis, and (3) the tools being mounted to be axially movable relative to each other along the common axis to a range of positions wherein the machinable surfaces of the ring are in sliding contact with the machining surfaces of the tools and into a predetermined position relative to each other.

2. The apparatus set forth in claim 1, further comprising stop means for limiting the axial movement of said tools toward each other in said predetermined position.

3. The apparatus set forth in claim 2, wherein said stop means are adjustable along said common axis.

4. The apparatus set forth in claim 1 wherein the tools are mounted for rotating in opposite senses about said common axis.

5. An apparatus for machining a conical ring having inside and outside conical machinable surfaces defining parallel generatrices, which comprises (a) an outer tool, (b) an inner tool, (1) the tools being mounted coaxially to be rotatable about a common axis, (2) the outer tool having an inside conical machining surface for machining the outside conical machinable surface of the ring and the inner tool having an outside conical machining surface for machining the inside conical machinable surface of the ring when the ring is disposed between the machining surfaces of the tools and is centered on the common axis, and (3) the tools being mounted to be axially movable relative to each other along the common axis to a range of positions wherein the machinable surfaces of the ring are in sliding contact with the machining surfaces of the tools and into a predetermined position relative to each other, and (c) two stops spaced apart along the common axis and defining the predetermined position, the stops being (1) engageable by the ring at opposite ends thereof when the machinable surfaces of the ring are disposed between the machining surfaces of the tools, and (2) each stop being mounted to be axially guided relative to the tools.

6. The apparatus set forth in claim 5, wherein two toolholding means are provided, which are spaced apart along said common axis, each of said tools is rotatably mounted in one of said toolholding means, and each of said stops is axially supported by spring means against one of said toolholding means.

7. The apparatus set forth in claim 5, wherein at least one of said stops is mounted to be rotatable about said common axis relative to said toolholding means.

8. The apparatus set forth in claim 5, wherein at least one of said stops is mounted to be rotatable about said common axis relative to said tools.

9. The apparatus set forth in claim 5, wherein one of said stops is mounted to be rotatable about said common axis relative to said toolholding means and the other of said stops is mounted to be rotatable about said common axis relative to said tools.

* * * * *